United States Patent [19]

Hara

[11] Patent Number: 4,529,957

[45] **Date of Patent: * Jul. 16, 1985**

[54] THERMAL CUTOUT FUSE

[75] Inventor: Kunio Hara, Kawasaki, Japan

[73] Assignee: Nifco Inc., Kanagawa, Japan

[ * ] Notice: The portion of the term of this patent subsequent to Oct. 30, 2001 has been disclaimed.

[21] Appl. No.: 633,509

[22] Filed: Jul. 23, 1984

Related U.S. Application Data

[63] Continuation of Ser. No. 425,677, Sep. 29, 1982, Pat. No. 4,480,247.

[30] Foreign Application Priority Data

Oct. 6, 1981 [JP] Japan ..... 56-158144

[51] Int. Cl.[3] ..... H01H 37/76

[52] U.S. Cl. ..... 337/407; 337/410

[58] Field of Search ..... 337/407, 408, 409, 410

[56] References Cited

U.S. PATENT DOCUMENTS 4,480,247 10/1984 Hara ..... 337/408

*Primary Examiner*—Harold Broome

*Attorney, Agent, or Firm*—Dressler, Goldsmith, Shore, Sutker & Milnamow, Ltd.

[57] ABSTRACT

A thermal cutout fuse comprises a housing, a first lead wire thrust into the housing, a movable contact connected to the first lead wire, a stationary contact disposed around the movable contact and electrically connected to a second lead wire, a coil spring having resilient force of bending elasticity large enough to support the movable contact and separate the movable contact from the stationary contact, a thermally sensitive pellet having a melting point which conforms to the preset unsafe temperature and disposed within the housing, and a solid member interposed between the thermally sensitive pellet and the movable contact and adapted to bring the movable contact into contact with the stationary contact against the bending elasticity of the coil spring.

2 Claims, 9 Drawing Figures

THERMAL CUTOUT FUSE

This is a continuation of application Ser. No. 425,677, filed Sept. 29, 1982, now U.S. Pat. No. 4,480,247.

BACKGROUND OF THE INVENTION

This invention relates to a thermal cutout fuse which opens an electric connection between a pair of lead wires at a preset temperature.

Generally, the thermal cutout fuse of this type has heretofore been preferred to have a construction combining a thermally sensitive pellet with a mechanical spring on account of relatively satisfactory thermal properties and relatively high reliability of cutout motion. To be specific in this construction, a stationary contact and a movable contact are disposed within a housing and, while a mechanical spring constantly energizes the movable contact in the direction departing from the stationary contact, a thermal pellet which retains a solid state and occupies a fixed volume below a prescribed unsafe temperature (melting point) directly or indirectly represses the force of the spring tending to move the movable contact away from the stationary contact. In the normal state of the thermal cutout fuse (below the preset unsafe temperature), the intimate continuity of the two contacts is maintained and the electric continuity between a pair of lead wires connected to the contacts is similarly maintained. When the ambient temperature of the fuse rises past the preset unsafe temperature and the thermal pellet immediately melts and liquefies, the energizing force of the mechanical spring is effectuated to break the electric continuity between the two lead wires by causing the movable contact to be slid out in the direction of departing from the stationary contact.

In the conventional thermal cutout fuse of such a construction as described above, the movable contact is adapted to slide inside the housing perpendicularly to the surface thereof normally held in contact with the stationary contact. During this slide, the peripheral surface of the movable contact rubs against the inner wall surface of the housing. If the rubbing force thus generated differs, if very slightly, from one thermal cutout fuse to another to be manufactured, there may arise a possibility that the slide of the movable contact will be obstructed or the movable contact will be forced to assume a slanted posture during the slide. In any event the conventional thermal cutout fuse has had a disadvantage that because of the rubbing during the slide, the movable contact will possibly fail to separate safely from the stationary contact. For the movable contact to produce safe slide, therefore, it becomes necessary to adopt a relatively large mechanical spring of high energizing force with due allowance or supplement the mechanical spring with an auxiliary spring adapted to keep the movable contact against the force tending to turn it aslant. Such special measures add to the complication, bulkiness, and production cost of the overall construction of the thermal cutout fuse.

With a view to improving the performance reliability of the conventional thermal cutout fuse, the present inventor developed a thermal cutout fuse having a novel cutout mechanism (U.S. Pat. No. 4,322,705).

SUMMARY OF THE INVENTION

An object of the present invention is to enhance further the reliability of the thermal cutout fuse disclosed as above.

The present invention, therefore, is characterized by being so constructed that the movable contact member is mechanically supported in position, that the coil spring exerts resilient force in the direction of separating from the stationary contact while the movable contact remains in intimate contiguity with the stationary contact avoids forming part of a current circuit, that the coil spring, while held in the aforementioned posture, acquires compressive elasticity in the longitudinal direction, and that consequently the movable contact, on being separated from the stationary contact, breaks its electrical connection with a first lead wire.

The other objects and the other characteristics of the present invention will become apparent from the further disclosure of this invention to be made hereinbelow with reference to the accompanying drawing.

DESCRIPTION OF PREFERRED EMBODIMENT

First, a thermal cutout fuse embodying the invention of U.S. Pat. No. 4,322,705 which forms the basis of the present invention will be described with reference to FIGS. 1, 2 to present the points in which the thermal output fuse needs improvement.

Figure 1:
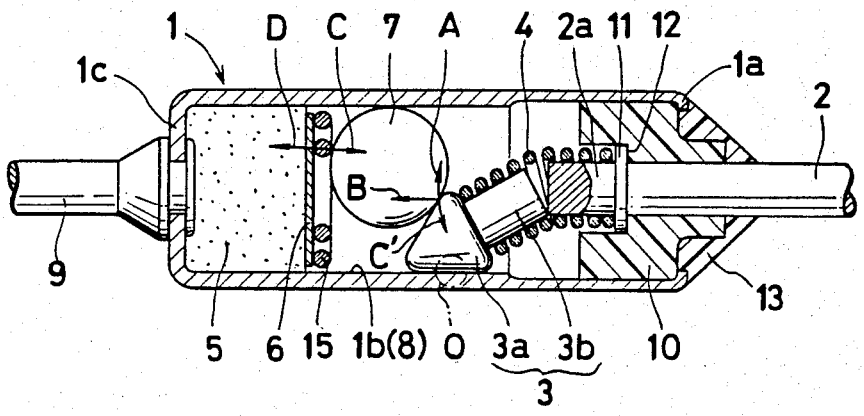
Fig 1 (PRIOR ART)
FIG. 1 is a sectional view illustrating a normal state of a conventional thermal cutout fuse to be subjected to the improvement of the present invention.

FIG. 1 represents a longitudinal section of the thermal cutout fuse in a state keeping electrical continuity of the circuit. A housing 1 is in the shape of a tube having one open end 1*a*. One end 2*a* of a first lead wire 2 penetrates through the open end 1*a* and the other end of the first lead wire which is now shown is extended out of the housing 1.

To the end 2*a* of the first lead wire 2 which thrusts into the housing 1, a conductive movable contact member 3 made of a metal, for example, is connected. The movable member 3 consists of a shank portion 3*b* having the rear end thereof held in contact with the thrust end of the lead wire and a movable contact face 3*a* at the leading end of the shank portion. Since the movable contact face 3*a* is abruptly diverged toward the shank portion, the movable contact member 3 as a whole assumes the shape of a mushroom.

A coil spring 4 made of a metal is wound astride round the outer surfaces of the thrust end 2*a* of the lead wire and the shank portion 3*b* of the movable contact member. This coil spring 4 is such that it keeps its axis straight while in a normal condition. When the movable contact member 3 is bent aslant in the radial direction relative to the lead wire 2 as illustrated in FIG. 1, the coil spring exerts resilient force (in the direction of the arrow A) against the force which has bent the coil spring simultaneously with the movable contact member 3. Consequently, the coil spring generates an energizing force which tends to spring the movable contact member up in the direction of the resilient force. Of course, this coil spring not only plays the part of energizing the movable contact in the horizontal direction but also functions to keep the lead wire 2 and the movable contact member 3 in mutual connection. Thus, the inside diameter of the coil spring 4 is slightly smaller than the diameters of the two parts 2*a*, 3*a* round which the coil spring is to be wound, so that the two parts may be forced into the coil spring.

It should be noted that in this conventional thermal cutout fuse, the coil spring 4 electrically forms a parallel current path relative to the current path formed by the thrust end 2*a* of the lead wire and the movable contact member 3. This fact has bearing upon the point of improvement which is provided by the present invention as will be fully described afterward.

The description of the construction of the conventional thermal cutout fuse will be continued. Inside the housing 1, a thermally sensitive pellet 5 formulated to melt abruptly at its melting point is disposed in a solid state of a fixed volume as opposed to the movable contact member 3. Between the surface of the thermally sensitive pellet 5 and the head portion 3*a* having a movable contact surface of the movable contact member 3, a solid member 7 is forcibly stowed in through the medium of a resilient sheet 6 preferably of silicone rubber or tetrafluoroethylene resin and an axially resilient member 15 such as a coil spring. In the diagram, the solid member 7 is depicted as a sphere made of a suitable insulating substance such as plastic or glass. After all, the purpose of the solid member 7 is such that owing to the presence thereof, the movable contact member 3 is bent aslant with the movable contact surface 3*a* held in intimate contiguity with the inner wall surface 1*b* of the housing.

In the illustrated embodiment, since the housing 1 itself is formed as a conductive member with a suitable metal, the inner wall 1*b* of the housing constitutes itself a stationary contact surface 8. A second lead wire 9 which is connected to the contact surface 8, therefore, is electrically and mechanically fastened by being caulked with a bottom end 1*c* of the housing.

In the normal state illustrated in FIG. 1, therefore, a current path is formed from the first lead wire 2, via the movable contact member 3, the inner wall 1*b* of the housing from the first lead wire 2, via the movable contact member 3, the inner wall 1*b* of the housing (stationary contact surface 8), and the housing 1, to the second lead wire 9. Besides this current path, the parallel current path formed with the coil spring 4 as described previously also exists.

The lead wire 2 is held fast in position by being pierced through an insulating bushing 10 which blocks the open end 1*a* of the housing. Possible slippage of the second lead wire through the bushing 10 is precluded by having a radially expanded portion 11 of the lead wire 2 fitted inside a recess 12 formed in the bushing. The open end 1*a* is provided with a suitable resin seal 13.

In the normal state described above, the movable contact member 3 is kept bent aslant and is energized by the coil spring in the direction of the arrow A, namely, in the horizontal direction. Conversely, this energizing force is conveyed as repulsive force to the solid member 7, a sphere in the illustrated embodiment, which keeps the movable contact member 3 in the slanted state. Consequently, there is produced a resultant force which tends to repel the solid member in the axial direction (the direction of the arrow B) through the interface of contact between the movable contact member 3 and the solid member 7. In other words, the force tending to separate the solid member 7 from the movable contact member 3 is always exerted upon the solid member 7. In the normal state, however, the thermally sensitive pellet 5 in a solid state is positioned behind this solid member to offer resistance to the force. Consequently, the solid member 7 is kept from being moved away and the movable contact member 3 is prevented from returning in the horizontal direction. Thus, the movable contact member 3 is retained in a state pressed against the stationary contact surface 8.

When the ambient temperature of the thermal cutout fuse rises to the preset unsafe temperature corresponding to the melting point of the thermally sensitive pellet 5 used in the fuse, this pellet 5 abruptly melts naturally owing to the well-known property inherent in this type of pellet.

As the result, the pellet which has assumed a solid state of a fixed volume and has successfully resisted the aforementioned force exerted in the axial direction B upon the solid member 7 is wholly divested of its repulsive force. By the same token, the solid member 7 is divested of its force tending to press the movable contact member 3. Consequently, the movable contact member 3 is sprung up horizontally and instantaneously separated from the inner wall 1*b* (stationary contact surface 8) of the housing at the mercy of the action of the energizing force (resilient force) of the coil spring 4. As a natural consequence, the solid member 7 is pushed away in the axial direction B.

Figure 2:
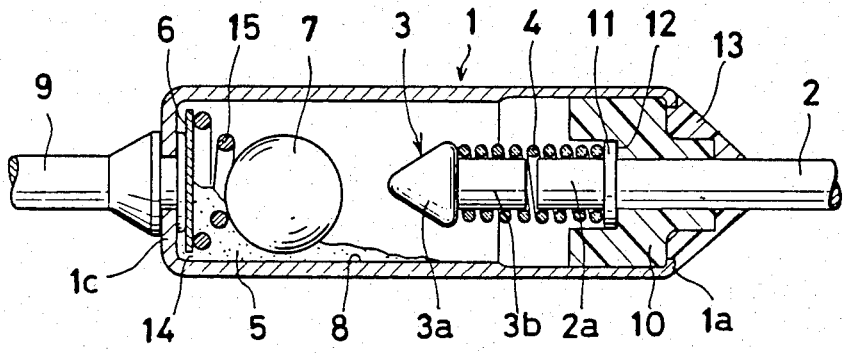
Fig 2 (PRIOR ART)
FIG. 2 is a sectional view illustrating a cutout state of a conventional thermal cutout fuse of FIG. 1.

The electric continuity between the two lead wires, therefore, is broken as illustrated in FIG. 2.

In the thermal cutout fuse, the movable contact member 3 has absolutely no possibility of generating any unnecessary frictional force when it is separated from the stationary contact surface upon fusion of the thermally sensitive pellet at the preset unsafe temperature. Thus, this thermal cutout fuse, unlike the earlier version described at the beginning of the specification, does not experience the disadvantage that the movable contact member encounters an obstruction during its separation from the stationary contact surface. It can be relied on to provide safe cutout of the fuse. The coil spring 4 of relatively small force will suffice for the purpose of the thermal cutout fuse.

In the illustrated embodiment, a second coil spring 15 is adopted as a resilient member. The second coil spring so used, owing to the force C exerted upon the solid member 7, generates a force C′ tending to press the movable contact member 3 more powerfully. Consequently, retention of the electric continuity between the two lead wires in the normal state can be ensured. In addition, since the second coil spring 15 produces a force component D exerted upon the pellet 5, it fulfils an additional role of quickly removing the pellet from behind the solid member after the pellet 5 has melted at the preset unsafe temperature. Thus, the second coil spring can contribute to ensuring the reliability and quickness of the cutout action of the fuse.

When the solid member 7 is in a spherical shape as in the illustrated embodiment, it can be allowed to roll about its center during the cutout motion of the fuse. Consequently, the motion of this solid member 7 inside the housing can be smoothened because it encounters little resistance from the inner wall of the housing. The sphere is not necessarily the only shape that the solid member 7 is allowed to assume. Instead, the solid member 7 may be in a conical shape, with the flat bottom face thereof continuous with the surface of the pellet. In this case, the conical surface is used to press the movable contact member fast in position. Otherwise, the solid member itself may be formed of an elastic substance. It is naturally permissible that the housing 1 will be formed of an electrically insulating substance and the inner wall surface 1*b* thereof will be provided with a separately formed stationary contact surface 8.

Owing to the aforementioned operating principle, the thermal cutout fuse has high reliability and enjoys amply high commercial value. There are times, however, when some of thermal cutout fuses manufactured so as to satisfy a specification may fail to provide satisfactory cutout motion for the following reason.

In the beginning of the cutout motion described above, when the movable contact surface 3*a* and the stationary contact surface 8 which have remained in intimate contiguity as shown within the enclosure of the chain line 0 in FIG. 1 verge on abrupt separation from each other, may possibly issue an arc therebetween. If the energy of this arc is fairly large, there is a possibility that the two contact surfaces 3*a*, 8 will be fused. This fusion naturally impairs the cutout motion of the fuse.

Figure 3:
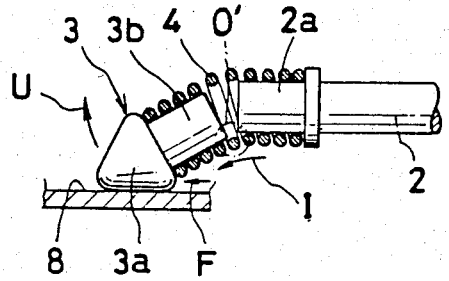
Fig 3 (PRIOR ART)
FIG. 3 is an explanatory view illustrating the thermal cutout fuse of FIGS. 1, 2 at the moment that the fuse is cut out.

As illustrated in FIG. 3 which depicts only the essential part of the thermal cutout fusion, the coil spring 4 acquires a force by the fact that it is kept bent aslant and, at the sametime, kept compressed in the longitudinal direction before the movable contact surface 3*a* and the stationary contact surface 8 are separated from each other. With this force, the coil spring 4 pushes the whole of the movable contact member 3 in the direction of the arrow F and, consequently, entails a possibility that the point of tight contact between the thrust end 2*a* of the lead wire and the shank portion 3*b* of the movable contact member indicated within the enclosure of a chain line 0′ may break off.

Once this contact is broken, the whole circuit current I flows soley through the coil spring 4 which has so far served as a parallel current circuit. Consequently, there ensues a possibility that the spring 4 will be abnormally heated and will be wholly divested of its springness. When this trouble occurs at all, the coil spring 4 can no longer be expected to jump up in the direction of the arrow U. If the circuit current I is suffered to flow continuously in the manner described above, it can burn only the spring 4 but also the pellet and the bushing.

The present invention has been basically directed to eliminating this disadvantage. It provides improvements for the elimination of the aforementioned possible defective cutout motion of the thermal cutout fuse as well.

Figure 4:
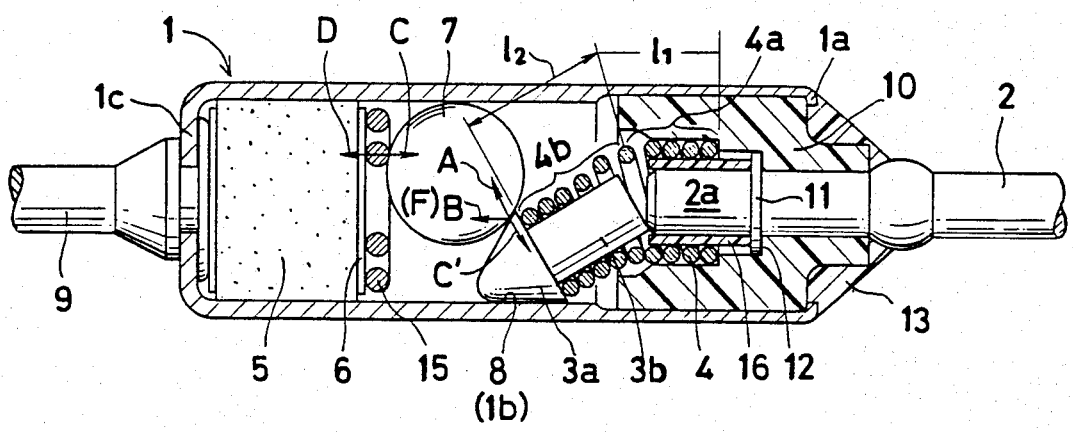
FIG. 4 is a sectional view illustrating the thermal cutout fuse as one embodiment of the present invention in its normal state.

The improvements of the present invention are substantially reflected in the movable contact member, the thrust end of the lead wire, and the coil spring disposed round such components. FIG. 4 represents a longitudinal section of the entire construction of a thermal cutout fuse incorporating the improvements of this invention. In the diagram, those components which may be substantially similar to the components of the conventional thermal cutout fuse are indicated by like symbols used in FIGS. 1, 2. The description of these components is omitted.

The first improvement offered by the present invention resides in the fact that the coil spring 4 which is fitted round the shank portion 3*b* of the movable contact member 3 and, therefore, is allowed to combine the functions of producing an energizing force in the upward direction and mechanically supporting the contact member 3 fast in position is adapted electrically so as to avoid foming a parallel current path relative to the circuit current path between the lead wires 2, 9, and more specifically the coil spring 4 is disposed astride round the shank portion 3*b* of the movable contact member and the thrust end 2*a* of the lead wire with an insulator layer 11 interposed between the coil spring 4 and at least either of the shank portion 3*b* and the thrust end 2*a*.

In pursuance of the principle of this improvement, the embodiment illustrated in FIG. 4 has an insulator layer 16 of Teflon (tetrafluoroethylene resin) tube disposed round the thrust end 2*a* of the lead wire. The coil spring 4 is fitted round this insulator layer 16.

Figure 5:
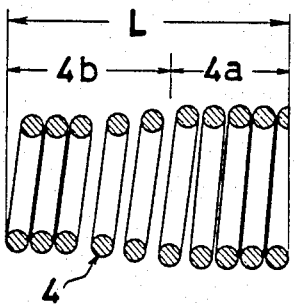
FIG. 5 is a sectional view illustrating a coil spring used in the thermal cutout fuse of FIG. 4.

As shown in FIG. 5 which illustrates the coil spring used in the embodiment of FIG. 4, this coil spring 4 is constructed so that the portion thereof joining the portion 4*a* disposed round the thrust end 2*a* of the lead wire through the medium of the tube 16 and the portion 4*b* disposed round the shank portion 3*b* of the movable contact member is smoothly diverged in the direction from the portion 4*b* to the portion 4*a* to accept insertion of the tube 16.

The second improvement offered by the present invention resides in the fact that the force A, i.e. the bending elasticity, which the coil spring 4 generate in the direction of resuming its original shape when it is bent down in the normal state of the thermal cutout fuse and the force, i.e. the compressive elasticity, which the coil spring 4 generates in the direction of stretching to its original shape when it is compressed amply in the axial direction (the longitudinal direction) are positively utilized.

It is now assumed that when the coil spring 4 is held in its loadless state as illustrated in FIG. 5, this coil spring 4 has a length L. When this coil spring is incorporated in the assembled thermal cutout fuse as illustrated in FIG. 4, it is compressed in such a manner that the sum of the lengths $l_1$, $l_2$ of the spring portions 4*a*, 4*b* along the axial lines will be smaller than the length L, thus $L > l_1 + l_2$.

When this condition is satisfied, generally the compressive elasticity is produced first and the bending elasticity is generated next as viewed from the standpoint of infinite division of time.

Figure 6:
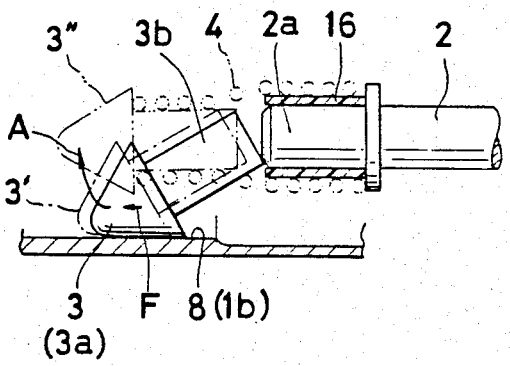
FIG. 6 is an explanatory view illustrating the cutout motion is started and the moment it is completed.

FIG. 6 represents the movement which the essential part of the thermal cutout fuse of FIG. 4 incorporating the aforementioned improvement of the present invention produces when the fuse is cut out. The movement of the fuse between the time the cutout motion is started and the time it is completed will be described with reference to this diagram. In the normal state of the thermal cutout fuse, the components making up the fuse and the forces exerted thereon are the same as those of the conventional countertype already described with reference to FIGS. 1, 2.

When the ambient temperature of the thermal cutout fuse rises past the preset unsafe temperature and the thermally sensitive pellet 5 is consequently liquefied, the pellet is quickly driven out from behind the solid member 7 preferably by the force D of the elastic member 15. Then, the solid member 7 is deprived of the force with which it preses the contact surface 3*a* of the movable contact member 3 to the stationary contact surface 8, with the result that the coil spring 4 is allowed to manifest the resilient force because of the aforementioned compressive elasticity and bending elasticity.

The movement of the thermal cutout fuse from this moment onward will be followed with reference to FIG. 6 along the course of time as divided infinitely. First, the compressive elasticity is effectuated toward causing the reduced total length, $l_1+l_2$, to return to the natural length L and consequently forcing the whole of the movable contact member 3 in the direction of the arrow F (indicated by the chain line 3' in FIG. 6). At this moment, the thrust end 2*a* of the lead wire and the shank portion 3*b* of the movable contact member are separated from each other. The electric continuity between the two lead wires 2, 9 is broken even if the continuity between the movable contact surface 3*a* and the stationary contact surface 8 remains intact.

It should be noted that in the thermal cutout fuse of the conventional construction, there is a possibility that the electric current I will be concentrated on the coil spring 4 and, consequently, the coil spring will function defectively without effecting desired breakage of the electric continuity.

In other words, such concentrated flow of electric current through the coil spring 4 as described above cannot occur in the thermal cutout fuse of the present invention because the coil spring 4 does not constitute a parallel current path. Instead, the coil spring 4 has ample resilient force accumulated therein to be sprung up by bending elasticity in the next step.

If the thrust end 2*a* and the shank portion 3*b* generate an arc therebetween at the moment they are separated from each other and this arc produces a fused portion therebetween, the resilient force amply accumulated within the coil spring 4 and tending to send the coil spring 4 flying in the direction of the arrow A breaks open the fused portion and sends the movable contact member 3 abruptly in the upward direction (as indicated by the chain line 3'') to materialize the cutout state finally.

Further, on the condition that the contiguity between the thrust end 2*a* and the shank portion 3*b* has already been broken, the resilient force due to the bending elasticity which is subsequently effectuated will bring about separation between the movable contact surface 3*a* and the stationary contact surface 8. Thus, there can be produced no arc between the two components 3*a*, 8.

Figure 7:
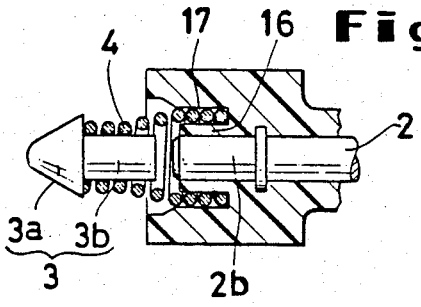
FIG. 7 is a schematic view of an essential part of another embodiment of the thermal cutout fuse according to the present invention.
Figure 8:
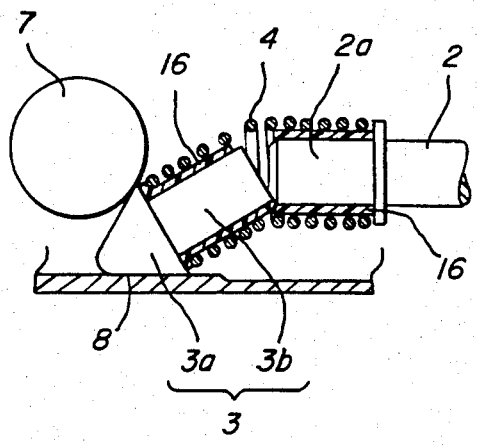
FIG. 8 is a view similar to FIG. 4 illustrating separate insulators disposed between the spring and contact members.
Figure 9:
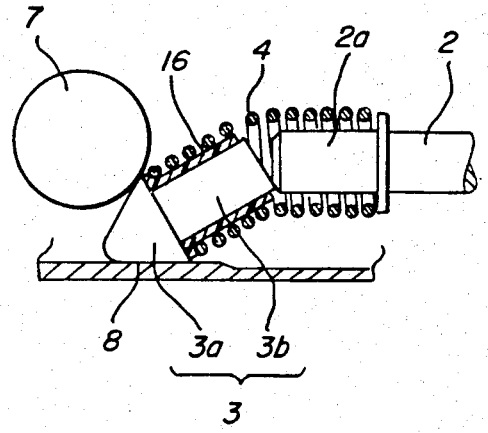
FIG. 9 is a view similar to FIG. 8 in which there is illustrated a single insulator between the spring and movable contact member.

The insulator layer 16 which prevents the coil spring 4 from constituting a parallel current path may be formed of a ceramic material or some other suitable insulating material in the place of a Teflon (tetrafluoroethylene resin) tube mentioned above. It may be formed additionally on the shank portion 3*b* of the movable contact member as shown in FIG. 8 or soley on the shank portion 3*b* as shown in FIG. 9. Otherwise, as shown in FIG. 7 which illustrates the essential part of the fuse, the bushing 10 may be provided with a portion 17 for admitting at least part of the portion 4*b* of the coil spring 4 and the bushing portion 16 intervening between the portion 17 and the thrust end 2*a* of the lead wire may be used as the insulator layer 16.

In accordance with the present invention, there is provided a highly reliable thermal cutout fuse which is perfectly free from the problem of arc formation inevitably suffered by the conventional thermal cutout fuse wherein the movable contact member is sprung up in the radial direction within the housing during the cutout motion of the fuse.

What is claimed is:

1. In a thermal cutout fuse comprising:

a movable contact member composed of a first lead wire thrust into a housing, a shank portion opposed to the thrust end of said first lead wire within the housing, and a movable contact surface formed at the lead end thereof, a stationary contact surface formed inside said housing round said movable contact surface and electrically connected to a second lead wire extended outwardly from said housing, a coil spring disposed astride round said shank portion of said movable contact member and said thrust end of said first lead wire and adapted to support mechanically said movable contact member in position and assume resilient force of bending elasticity tending to separate said movable contact member from said stationary contact surface toward a second posture when said movable contact member is brought into a first posture having the movable contact surface kept in contiguity with said stationary contact surface, a thermally sensitive pellet formulated to have a melting point conforming to the preset unsafe temperature and disposed inside said housing opposite said movable contact member, and a solid member interposed between said thermally sensitive pellet and said movable contact member and adapted to keep said movable contact member in said first posture against the bending elasticity of said coil spring, the improvement which comprises an insulator layer interposed between said coil spring and said movable contact member and said coil spring adapted to assume compressive elasticity in the longitudinal direction thereof in said first posture having contiguity between said movable contact surface and said stationary contact surface and between said shank portion of said movable contact member and said thrust end of said first lead wire, whereby said shank portion and said thrust end are separated from each other during the beginning of the motion toward said second posture.

2. A thermal cutout fuse as set forth in claim 1 in which an insulator layer is interposed between the coil spring and the thrust end of said first lead wire.

* * * * *